US005704482A

United States Patent [19]

Apps et al.

[11] Patent Number: 5,704,482

[45] Date of Patent: Jan. 6, 1998

[54] NESTABLE DISPLAY CRATE WITH EXTENDED HANDLES

[75] Inventors: William P. Apps, Alpharetta; Gerald R. Koefelda, Atlanta, both of Ga.

[73] Assignee: Rehrig Pacific Company, Inc., Los Angeles, Calif.

[21] Appl. No.: 423,352

[22] Filed: Apr. 18, 1995

Related U.S. Application Data

[63] Continuation-in-part of Ser. No. 268,997, Jun. 30, 1994, Pat. No. 5,465,843, which is a continuation-in-part of Ser. No. 18,317, Feb. 3, 1994, Pat. No. Des. 361,431.

[51] Int. Cl.[6] ..... B65D 21/032

[52] U.S. Cl. ..... 206/510; 206/427; 220/756; 220/771; 220/DIG. 15

[58] Field of Search ..... 206/505, 510, 206/509, 511, 512, 427, 203, 563, 564, 821; 220/756, 771, DIG. 15, DIG. 2, 509, 516, 772, 4.27

[56] References Cited

U.S. PATENT DOCUMENTS

| | | | |
|---|---|---|---|
| D. 224,366 | 7/1972 | Rehrig . | |
| D. 244,486 | 5/1977 | Johnson et al. . | |
| D. 247,648 | 3/1978 | Carroll et al. . | |
| 2,535,493 | 12/1950 | Gerber | 206/510 |
| 2,646,186 | 7/1953 | Russell | 206/510 |
| 2,777,597 | 1/1957 | Ruff | 206/510 |
| 3,009,579 | 11/1961 | Ettlinger, Jr. . | |
| 3,052,373 | 9/1962 | Frater . | |
| 3,265,237 | 8/1966 | Pache et al. . | |
| 3,270,913 | 9/1966 | Bridenstine et al. . | |
| 3,332,574 | 7/1967 | Earp . | |
| 3,349,943 | 10/1967 | Box . | |
| 3,392,869 | 7/1968 | Needt . | |
| 3,744,707 | 7/1973 | Ross . | |
| 3,794,208 | 2/1974 | Roush et al. . | |
| 3,997,057 | 12/1976 | Craig . | |
| 4,095,720 | 6/1978 | Delbrouck et al. . | |
| 4,101,049 | 7/1978 | Wallace et al. . | |
| 4,105,117 | 8/1978 | Atkin et al. . | |
| 4,143,764 | 3/1979 | Moss, III . | |
| 4,256,224 | 3/1981 | Hirota . | |
| 4,266,714 | 5/1981 | Crane | 206/510 |
| 4,319,685 | 3/1982 | David . | |
| 4,342,388 | 8/1982 | Torokvei | 206/510 |

(List continued on next page.)

FOREIGN PATENT DOCUMENTS

| | | | |
|---|---|---|---|
| 1 351 218 | 3/1963 | France . | |
| 28 01 077 | 7/1978 | Germany . | |
| 27 12 748 | 9/1978 | Germany . | |
| 563318 | 12/1955 | Italy | 206/510 |
| 674883 | 11/1964 | Italy | 206/510 |
| 725683 | 11/1966 | Italy . | |

*Primary Examiner*—Stephen J. Castellano
*Attorney, Agent, or Firm*—Banner & Witcoff, Ltd.

[57] ABSTRACT

A low depth, nestable display crate for bottles is integrally molded from plastic and comprises two basic components—a floor and a wall structure extending up from the floor and extending around the periphery of the floor. The floor has bottle support areas. The wall structure comprises a lower wall portion adjacent the floor and a plurality of integrally formed pylons arranged along the sidewalls of the wall structure. The endwalls of the wall structure comprise extended handles which may be grasped in either a palm-up or palm-down orientation and allow for minimum crate dimensions. The handles are configured so as to provide sufficient clearance for a user's hands to grasp the handles. The extended configuration also provides for easy lifting as the handle bars are located well above the center of gravity of the crate for easy lifting. In a preferred embodiment, the pylons are angled toward the interior of the crate and tapered to be smaller in cross section at the top and larger near the lower wall portion so as to allow corresponding pylons of a similar empty crate to nest within one another. The crate of the present invention combines the advantages of a nesting crate with sufficient strength afforded by its double-walled construction; maximum, unobstructed visibility of the bottles; and ergonomically designed handles which alleviate fatigue and the occurrence of hand-wrist injuries.

13 Claims, 12 Drawing Sheets

U.S. PATENT DOCUMENTS 4,410,099 10/1983 deLarosiere .
4,759,451 7/1988 Apps .
4,773,554 9/1988 Warwick .
4,899,874 2/1990 Apps et al. .
4,928,841 5/1990 Arthurs .
4,932,532 6/1990 Apps et al. .
4,944,400 7/1990 Van Onstein et al. .
4,978,002 12/1990 Apps et al. .
5,060,819 10/1991 Apps .
5,096,085 3/1992 Eek et al. .
5,097,890 3/1992 Nakao .
5,105,948 4/1992 Morris et al. .
5,335,814 8/1994 Hepp .
5,426,890 6/1995 Dümmen .
5,465,843 11/1995 Koefelda ..... 206/509

NESTABLE DISPLAY CRATE WITH EXTENDED HANDLES

CROSS-REFERENCE TO RELATED APPLICATION

This application is a continuation-in-part of patent application Ser. No. 08/268,997 filed Jun. 30, 1994, now U.S. Pat. No. 5,465,843, which is a continuation-in-part of design patent application 29/018,317 filed Feb. 3, 1994, now U.S. Pat. No. D361,431,the disclosures of which are hereby incorporated by reference in their entireties.

BACKGROUND OF THE INVENTION

The present invention relates to a nestable display crate for transporting and storing containers, more particularly, the present invention relates to crates or trays that combine nestability, high strength, improved visibility for displaying bottles and specially engineered handling features.

Bottles, particularly for soft drinks and other beverages, are often stored and transported during the distribution stages thereof in crates or trays. The term "crate" or "tray" as used herein includes crates, trays and similar containers having a bottom and peripheral sidewall structure. These crates generally are configured to be stacked on top of each other when loaded with bottles, and nested together when empty of bottles. The plastic crates provide advantages such as conservation of storage space and efficient, easy handling and recyclability. In order to minimize the storage space of the crates when nested and to reduce cost and weight, many crates today are made with a shallow peripheral sidewall structure. These generally are referred to as "low depth" crates in which the bottles bear most of the load of above-stacked crates. Crates having a higher peripheral sidewall, approximately the same height as the bottles generally are referred to as "full depth" crates in which the crates themselves bear most of the load of above-stacked crates.

Low depth crates are generally less expensive and lighter in weight than similarly constructed full depth crates. Thus, low depth crates are used extensively. Generally, low depth crates have been designed with a plurality of columns interconnecting a top band to a floor. An example of such a low depth tray for cans is disclosed in commonly assigned U.S. Pat. No. 5,184,748, the disclosure of which is hereby incorporated by reference in its entirety. The tray disclosed in the '748 patent is a nestable tray meaning that identical empty trays can be nested together to conserve retail or storage space.

Another example of a known low depth bottle crate for bottles is disclosed in commonly assigned U.S. Pat. No. 5,060,819, the disclosure of which is also hereby incorporated by reference in its entirety. The bottle crate of the '819 patent has a sidewall structure with upright adjacent panels, alternating ones of which are raised such that their lower surfaces are spaced above the floor. The top and bottom edges of the sidewall thereby have an undulating configuration such that empty trays can nest together.

One of the problems associated with previous nestable crates has been the lack of strength when used in some settings. The tray of the '819 patent, for instance, has a sidewall which may not stand up to very rough handling over time. Accordingly there has been a need for reusable nestable crams having the requisite strength and rigidity to withstand repeated or rough handling.

Bottles are generally packed by bottlers in cases, several bottles to the case, for shipment to retailers or for storage.

Cases of bottles are customarily stacked on top of each other. One way of handling the cases of bottles is to stack the cases on pallets which can be lifted and moved about by fork-lift trucks. A technique for interconnecting columns of cases, is called cross-stacking, and is often used to improve stability of a stack of cases, or for display purposes by the retailer. There has been a need for bottle cases having structural features which facilitate handling of stacked and cross-stacked loaded cases, enhances stability of stacked columns of such cases and provides maximum visibility of the bottles, especially in a retail setting.

Another problem experienced with previous nestable crates has been somewhat limited visibility of the bottle or bottle labels. Although the column and band trays, such as the one disclosed in the '748 patent, do allow for much of the labels to be displayed, the band obstructs the view of the bottles to some degree. Similarly, the undulating sidewall of the '819 tray allows for some visibility. There has been a need for a nestable crate which has improved structural strength and provides increased bottle or bottle visibility in strengthening the crate structure.

SUMMARY OF THE INVENTION

Accordingly, it is a principal object of the present invention to provide a low depth bottle crate which is nestable with other similar crates when empty to conserve space, and which is stackable and cross-stackable with other similar crates when loaded with bottles or bottles for storing, displaying and transporting the bottles.

Another object of the present invention is to provide a low depth, nestable crate with improved handling features for reduction in the occurrence of hand and wrist injuries and fatigue.

Another object of the present invention is to provide a sturdy low depth, nestable crate which also provides maximum visibility of the bottles or bottles for display and marketing purposes.

Still another object of the present invention is to provide a low depth, nestable crate which has sufficient structural strength to withstand repeated and rough handling and transport.

Yet another object of the present invention is to provide a low depth, nestable crate which makes efficient use of space both when loaded and stacked and when empty and nested.

Directed to achieving these objects, a new low depth, nestable crate for 20 bottles is herein provided. The preferred configuration is for bottles of one to two liter capacity. It will be understood that while the preferred embodiment of the present invention is configured for retaining bottles, the crate may be used to store or transport any type of bottle. This crate is formed by integrally molding from plastic, two basic components —a floor and a wall structure extending up from the floor and extending around the periphery of the floor.

The wall structure comprises distinctly different sidewalls and endwalls. The sidewalls comprise a lower wall portion adjacent the floor and a plurality of integrally formed pylons arranged along the sidewalls of the crate. It will be understood that "pylon" denotes the upwardly extending hollow columns or posts. The lower wall portion is of double-walled construction since the hollow pylons naturally lend themselves to being integrally formed with such a double-walled lower portion. The hollow pylons may be angled slightly toward the interior of the crate and tapered to be smaller in cross section at the top and larger near the lower wall portion so as to allow pylons of empty crates to nest within one another. The pylons are preferably positioned between adjacent support areas of the floor so that in profile, the sidewalls of the crate have a sawtooth-like appearance. The bottles loaded in the crate are visible through the open spaces between the pylons as shown in FIGS. 9 and 18. The crate of the present invention combines the advantages of a nesting crate with sufficient strength afforded by its double-walled construction with maximum, unobstructed visibility of the bottles.

The endwalls of the wall structure of the present crate include integrally molded extended handles which are constructed for ease of handling, and to alleviate injuries or undue fatigue to a user's hands and wrists. The handles are extended and protrude upward from the remainder of the wall structure to provide sufficient clearance for a user's hands without enlarging the dimensions of the crate. The handles are also configured to nestingly accommodate handles of an identical crate when crates are nested together.

The floor of the present crate has bottle support areas, preferably arranged in an array. The floor may also have an open lattice design which not only allows unwanted fluids to drain out of the crate, but also requires less material and is light weight. The outer or bottom surface of the floor may be configured for accommodating the tops of bottles in a similar crate underneath. The floor bottom surface may also include receiving areas adapted to receive the tops of bottles contained in a similar crate therebeneath to aid in retaining the bottles in vertically upright positions which enhances the stability of stacked loaded crates.

These and other features and advantages of the invention may be more completely understood from the following detailed description of the preferred embodiments of the invention with reference to the accompanying drawings.

DETAILED DESCRIPTION OF THE PREFERRED EMBODIMENTS

Figure 1:
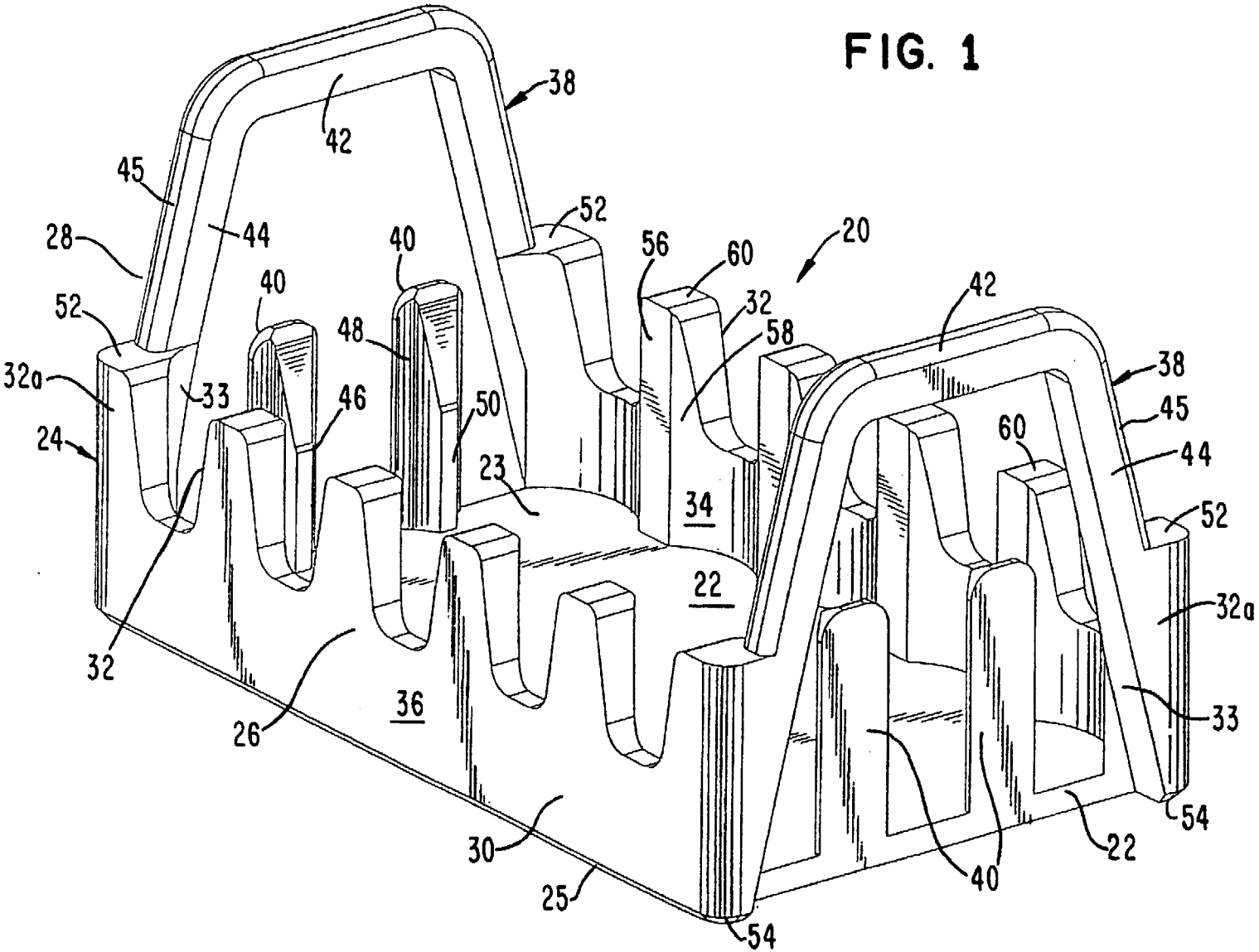
FIG. 1 is a perspective view of the crate in accordance with a first preferred embodiment of the present invention.

The present invention is a low depth crate which has structural features to afford sufficient strength, facilitate nesting of empty crates, provide maximum visibility to the bottles or bottles and improve handling characteristics. The present invention is especially adaptable for bottles of one to two liter capacity, either glass or plastic.

Crate 20 comprises two basic elements, a floor 22 and a wall structure 24. Floor 22 comprises bottle support areas 23 which are arranged in rows and columns to thereby define an array. Support areas 23 are adapted to retain bottles in relatively close relation so as to prevent jostling during handling. Excess movement of the bottles is to be avoided in order to ensure that they remain in a vertically upright position to most advantageously bear the load of crates stacked thereabove. In addition, the periphery of floor is finished with a beveled edge 125 to facilitate handling by allowing hand trucks to slide easily under the crate. Crate 20 is preferably substantially rectangular, and the wall structure defines the periphery of crate 20 with sidewalls 26 and endwalls 28. Sidewalls 26 comprise lower wall portions 30 and a plurality of pylons 32.

Lower wall portion 30 has an interior surface 34 which is integral with floor 22. In addition to the sidewall pylons 32, a corner pylon **32*a* is disposed in each corner of crate 20. All pylons 32 and 32a are integrally formed with lower wall portion 30 and the floor. Pylons 32 and 32*a* are preferably hollow, and extend upward from the floor and beyond lower wall portion 30. Pylons 32 and 32*a* are integral with interior lower wall portion 34 and also with exterior lower wall portion 36. Interior lower wall portion 34 and exterior lower wall portion 36 combine to provide a double-walled construction to crate 20 such that they are respectively contiguous with the interior and exterior surfaces of the pylons. This construction ensures that crate 20** will have sufficient strength and rigidity for a variety of handling situations.

In the first preferred embodiment of the invention, sidewalls 26 of crate 20 are substantially vertical, and pylons 32 are arranged between adjacent bottle support areas 23 of the floor and define spaces or windows 37 therebetween. In this manner, when crate 20 is loaded with bottles which are seated on support areas 23, the sides of the bottles are visible through windows 37 for attractive displays, especially in a retail setting.

Figure 2:
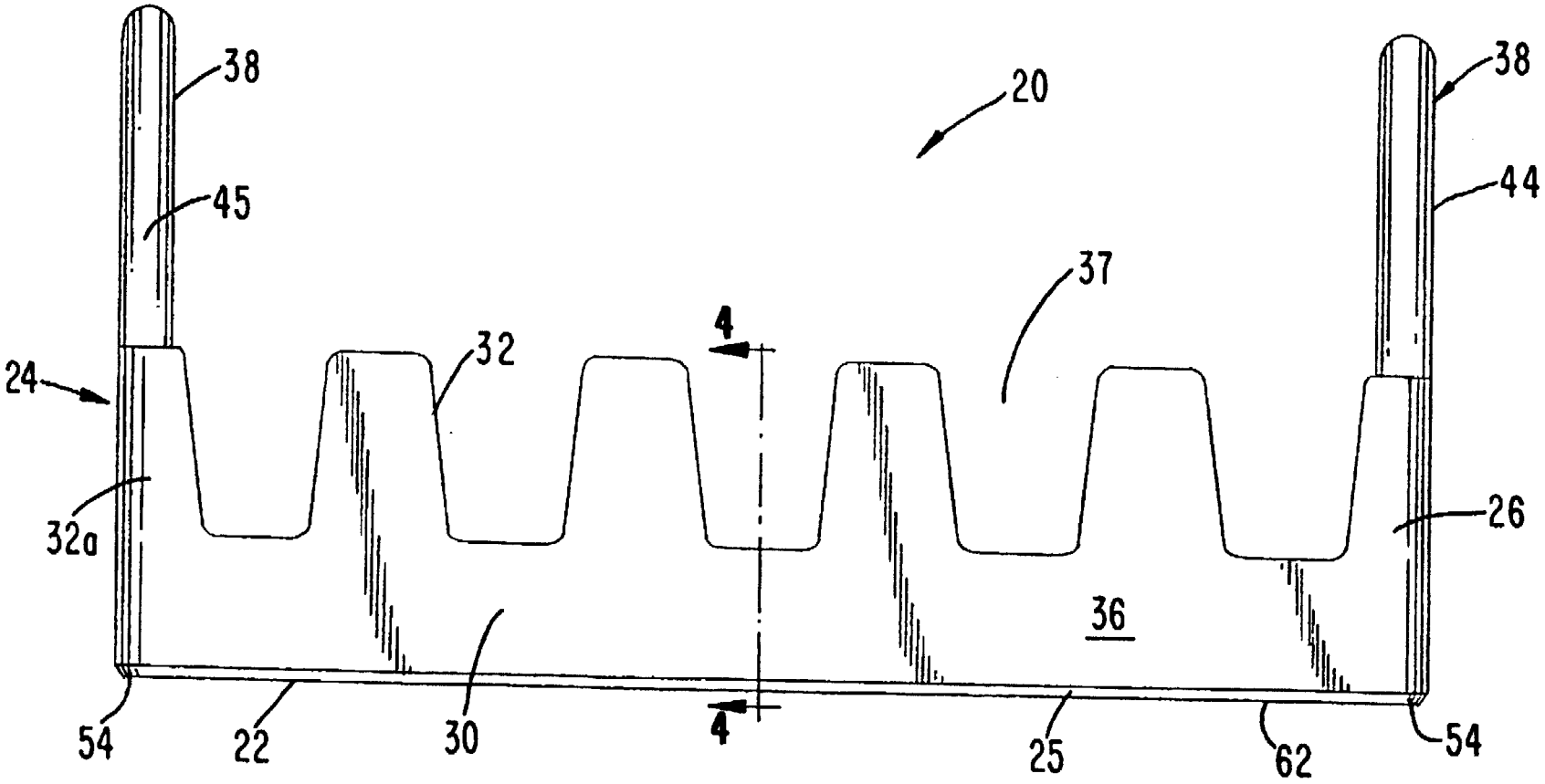
FIG. 2 is a side elevational view of the sidewall of the crate of FIG. 1.
Figure 3:
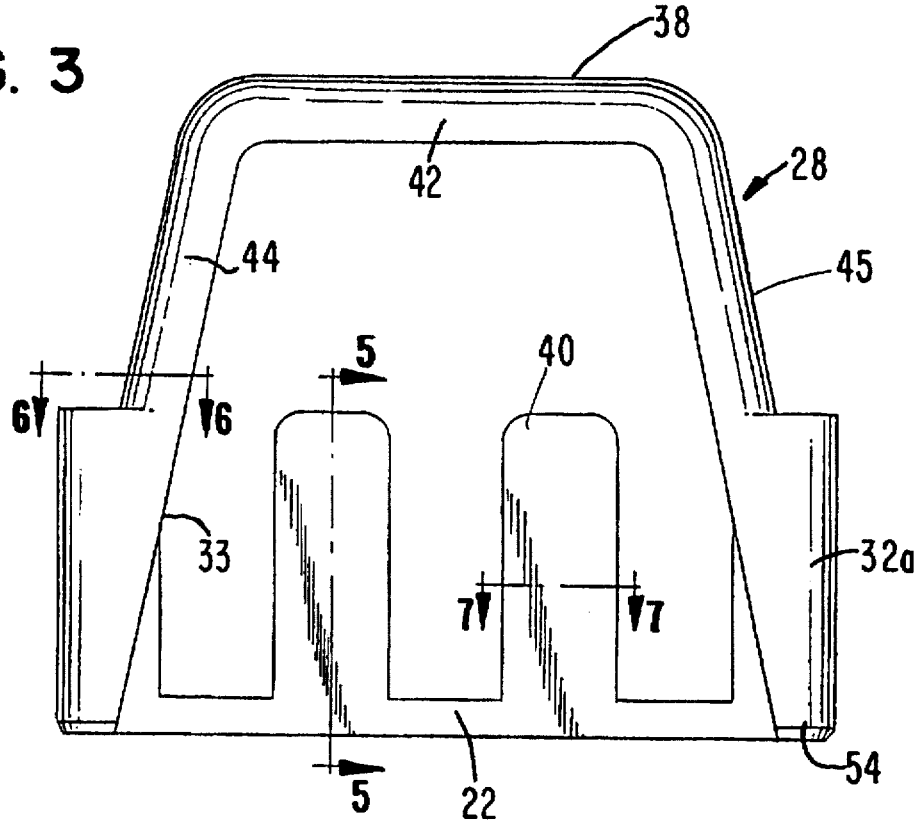
FIG. 3 is an end elevational view of the endwall of the crate of FIG. 1.
Figure 6:
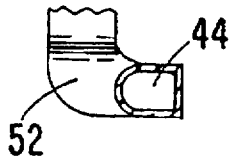
FIG. 6 is a cross sectional view of the crate taken along line 6—6 of FIG. 3.
Figure 4:
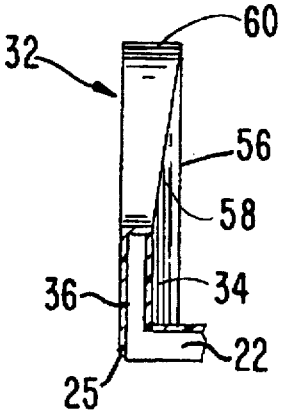
FIG. 4 is a cross sectional view of the crate taken along line 4—4 of FIG. 2.
Figure 5:
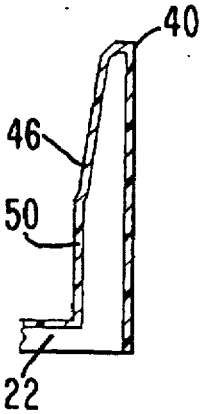
FIG. 5 is a cross sectional view of the crate taken along line 5—5 of FIG. 3.
Figure 7:
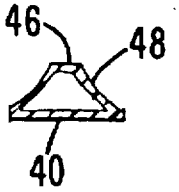
FIG. 7 is a cross section of the crate taken along line 7—7 of FIG. 3.

Endwalls 28 of crate 20 comprise extended handles 38 and endwall posts 40, the exterior surfaces of which are flush with the edge of floor 22. Endwall posts 40 are inwardly offset a distance equal to the thickness of handles 38 from corner pylons **32*a*, and the corner pylons have interior nesting surfaces 33 on their endwall sides. Handles 38 extend upwardly from corner pylons 32*a*, and comprise horizontal handle bars 42 integral with handle supports 44 which extend angularly upward from the corner pylons. Handle supports 44 of each handle 38 diverge from handle bar 42 such that the handle has a generally trapezoidal configuration with the handle bar defining the short side of a trapezoid and the supports defining the diverging legs. The length of handle supports 44 may vary depending upon the desired extent of the handles, and preferably is substantially similar to the height of a pylon or greater as seen in FIGS. 2 and 3. The length of the handle supports may be determined such that the handle bar is slightly lower than the tops and above the shoulders of the bottles so that the bar can be easily grasped. Handle supports 44 have exterior nesting surfaces 45** which are adapted to engage the interior nesting surfaces of another crate when nested.

The configuration of handles 38 results from a combination of designing the crate to maximize clearance space for a user's hands and to minimize the crate's overall dimensions. The optimum design for a crate is to keep the overall dimensions of the crate as close as possible to the overall dimensions of the array of containers.

Figure 10A:
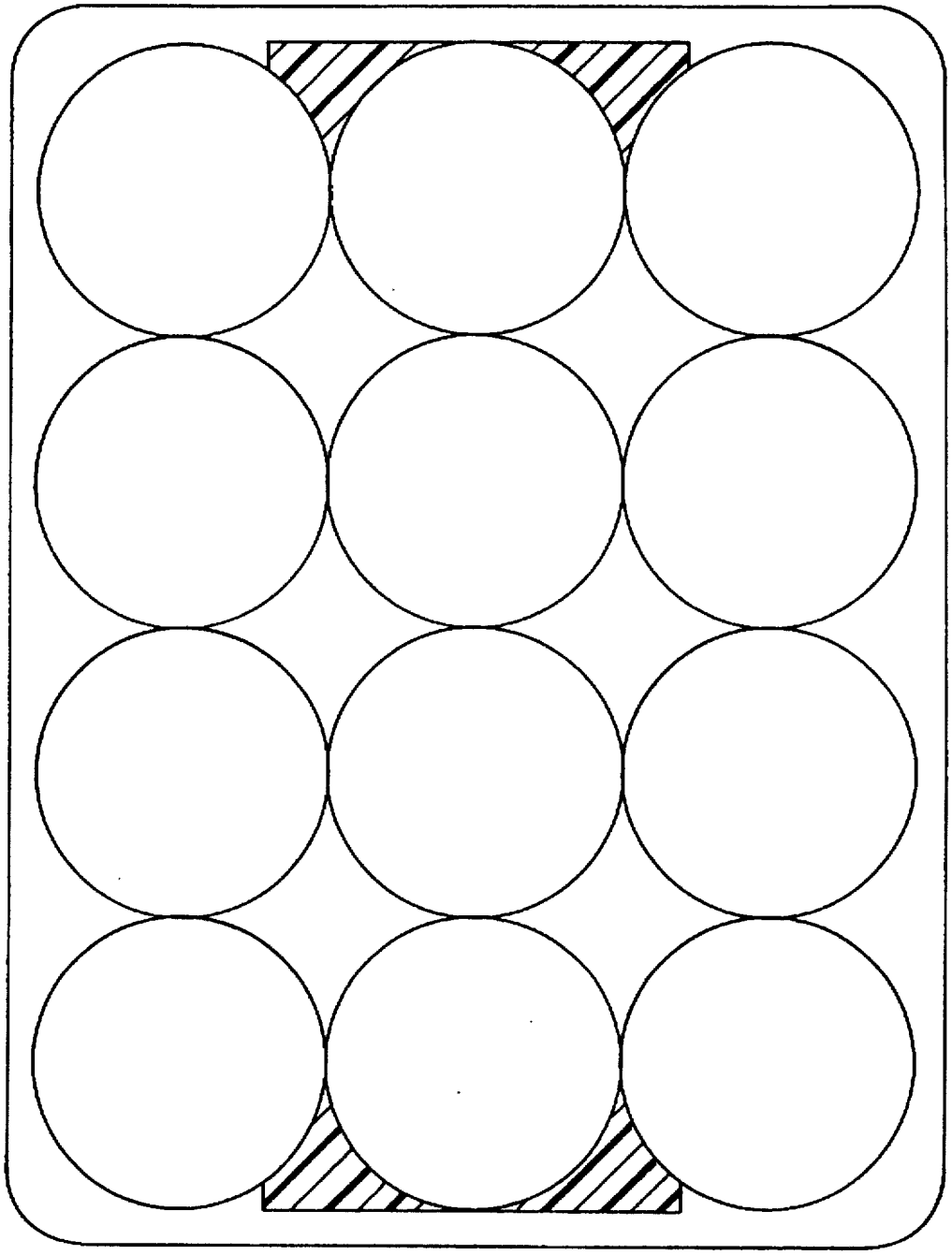
FIG. 10*a* is a schematic representation of a top view of a crate similar to the crate of FIG. 1 which circles represent the bottles and the cross-hatched areas represent areas for grasping the handle.
Figure 10B:
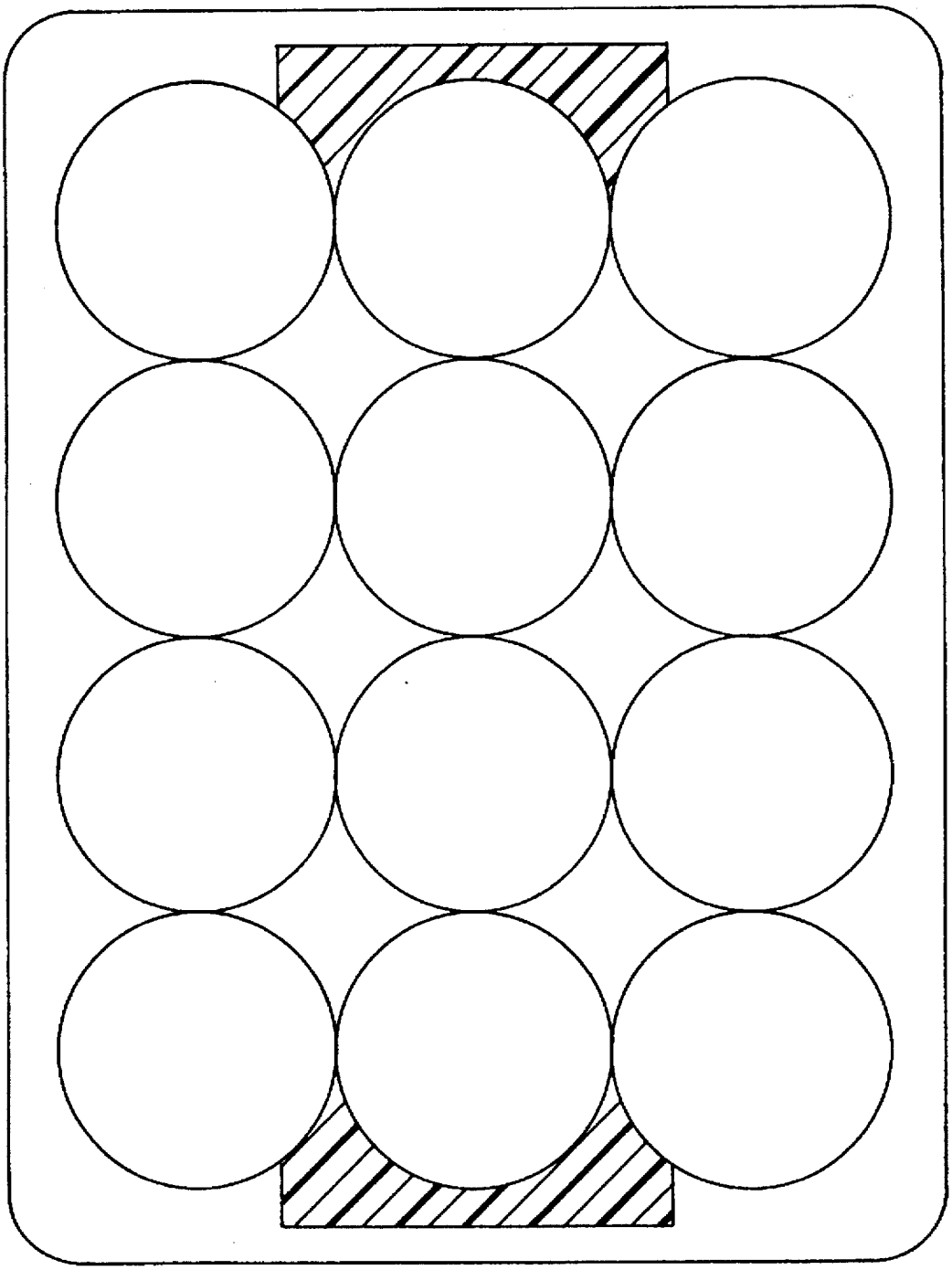
FIG. 10*b* is a schematic representation of a top view of a crate similar to the crate of FIG. 1 which circles represent the bottles and the cross-hatched areas represent areas for grasping the handle.
Figure 11:
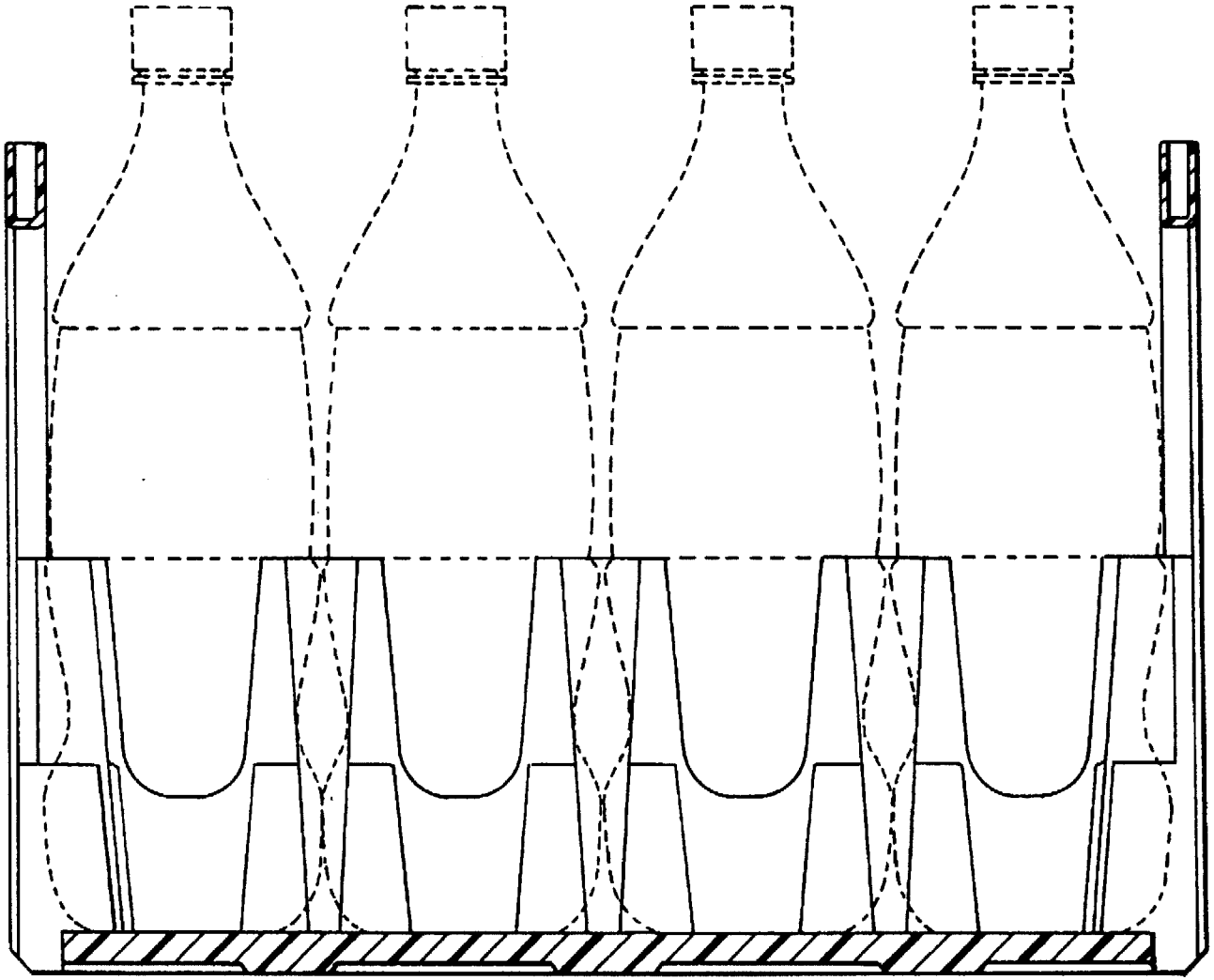
FIG. 11 is a schematic representation of the crate of FIG. 10 shown with bottles in broken line.
Figure 12:
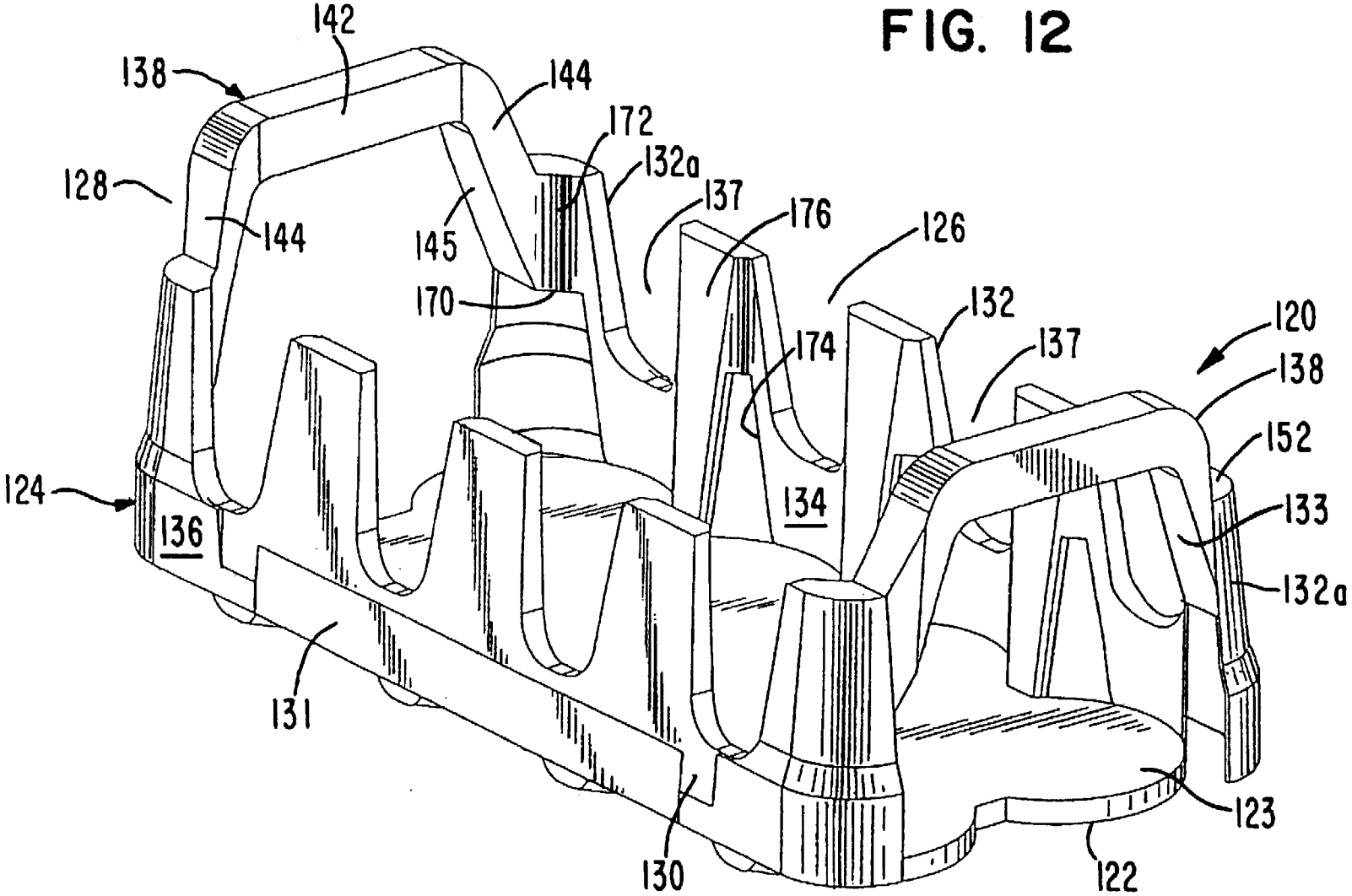
FIG. 12 is a perspective view of the cram in accordance with a second preferred embodiment of the present invention.
Figure 13:
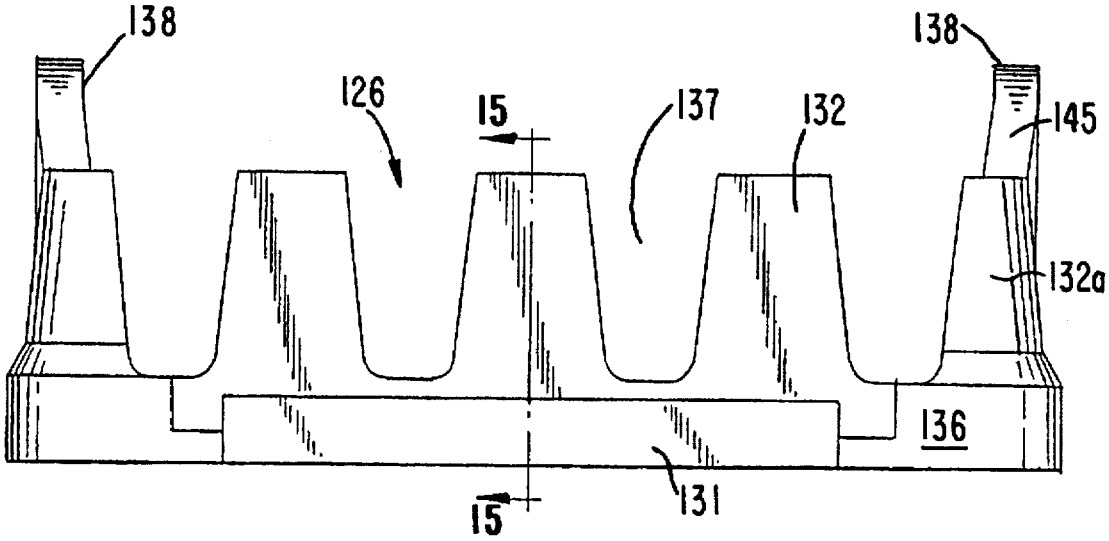
FIG. 13 is a side elevational view of the sidewall of the crate of FIG. 12.
Figure 14:
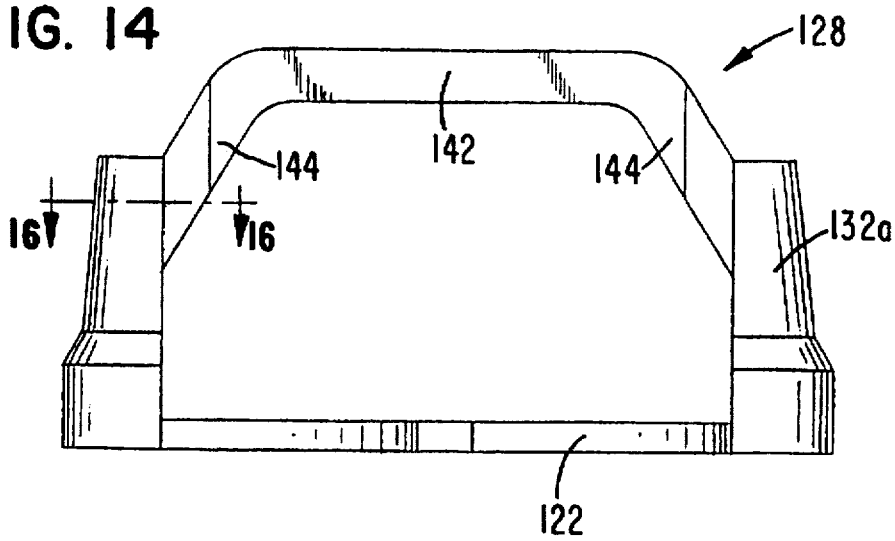
FIG. 14 is an end elevational view of the endwall of the crate of FIG. 12.
Figure 15:
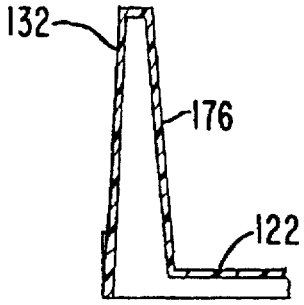
FIG. 15 is a cross sectional view of the crate taken along line 15—15 of FIG. 12.
Figure 16:
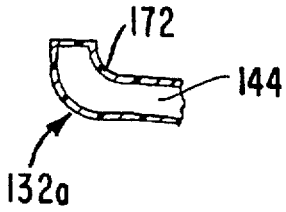
FIG. 16 is a cross section of the crate taken along line 16—16 of FIG. 14.
Figure 17:
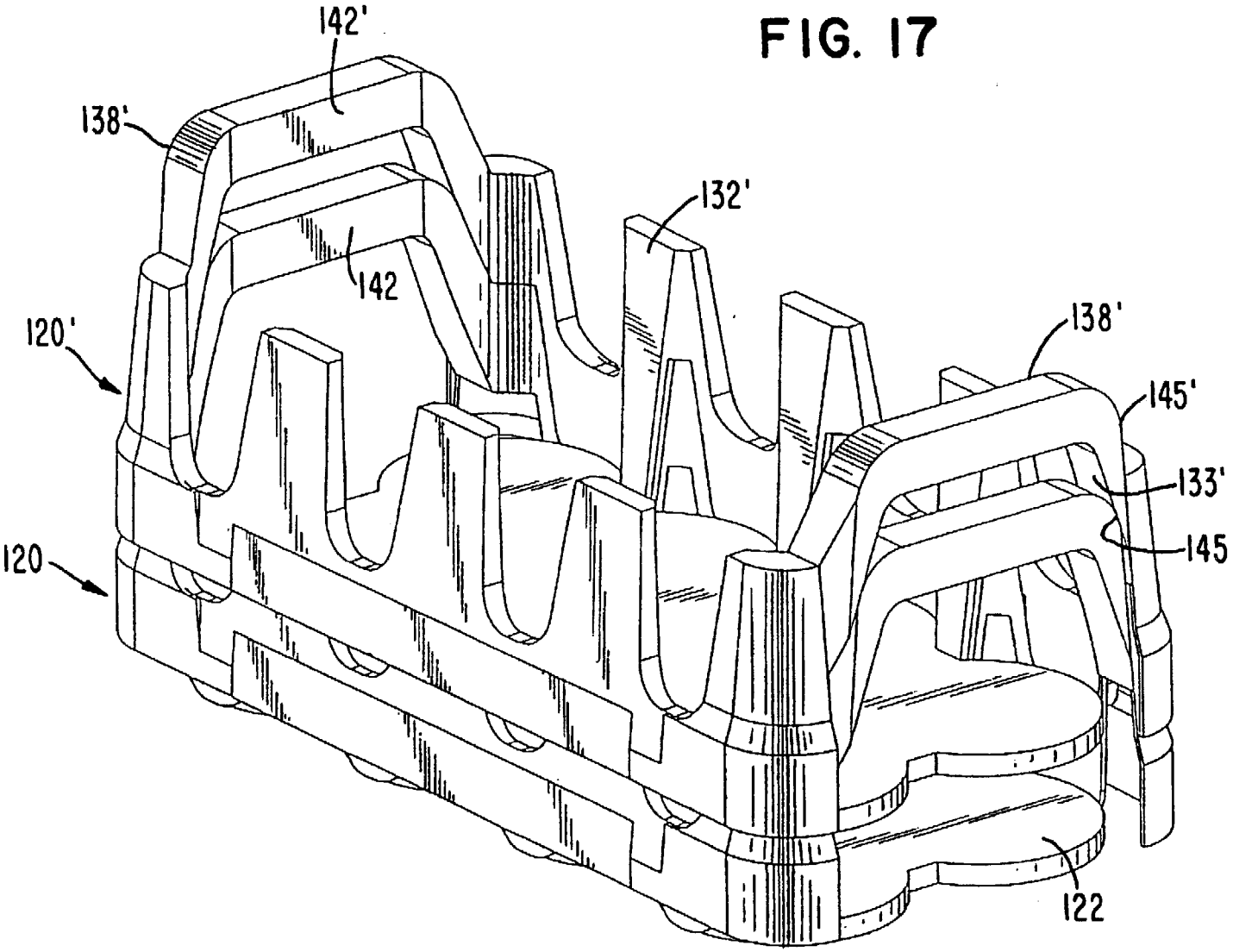
FIG. 17 is perspective view of the crate of FIG. 12 shown nested with identical crates.
Figure 18:
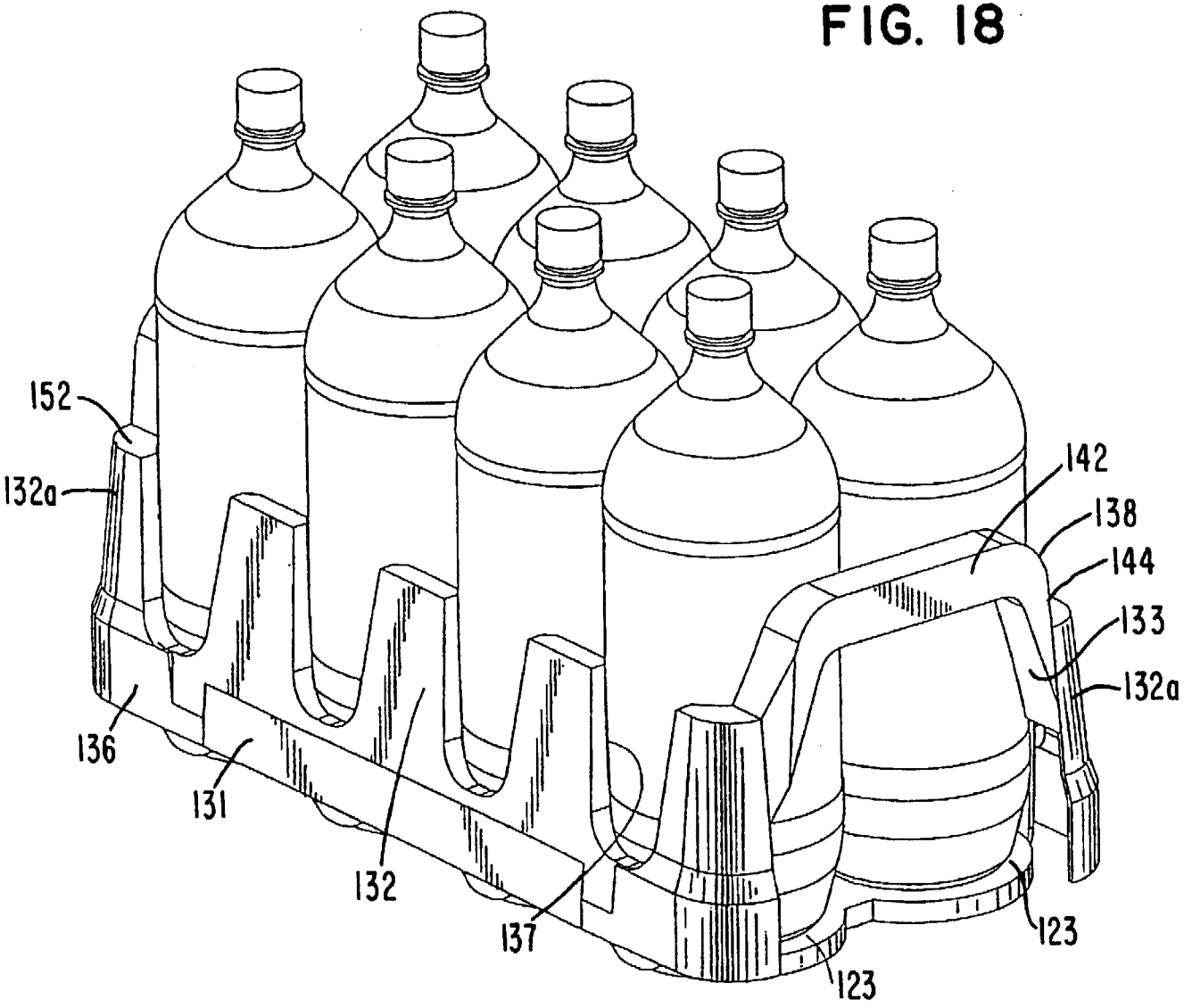
FIG. 18 is a perspective view of the cram of FIG. 12 shown loaded with bottles.

In certain configurations of crates for holding certain capacity bottles, the arrangement of the bottles interferes with the handling capabilities in prior art crates. As can be appreciated from FIG. 10*a*, in a crate holding a 3-by-4 array of one liter bottles, a central bottle along each endwall is in line with the handle area. The shaded area H represents the amount of clearance space for a user's hands. The space H in FIG. 10a is not sufficient for comfortably handling the crate by a user with average sized hands. To accommodate the hands, the overall dimensions of the crate could be enlarged as in FIG. 10*b* to provide a larger area H. But enlarging the crate to accommodate handles would not be the most expedient design. To solve this problem, the handles of the present invention are extended so that the handle bars are located above the shoulders of the bottles where there is sufficient space for a user's hands, as seen in FIG. 11.

Extending the handles allows crate 20 to be grasped either in a "palm-up" or "palm-down" position. The palm-up position refers to the position of a user's hands when the fingers are inserted below handle bars 42 from the outside such that the palms are generally face up and/or in. The palm-down position refers to the position of a user's hands when the fingers are inserted below handle bars 42 from the inside of the crate such that the backs of the hands are facing each other and the palms are generally facing down and/or out. The extension of handles 38 provides plenty of clearance for either method of handling the crate.

Handles 38 are also extended in order to locate the lifting area well above the center of gravity of the crate for easy lifting. Providing a user with the option of handling the crate in either hand position helps to alleviate fatigue and prevent hand-wrist injuries since a natural grasping motion can be used. The importance of this feature may be appreciated even more when the crate is sized for larger bottles, and the weight of a loaded crate is substantial. In addition, handles on prior crates and trays may have been too constricting on some users'hands, and may have required awkward and harmful hand/wrist positions, particularly when lifting and handling relatively heavy crates.

Figure 9:
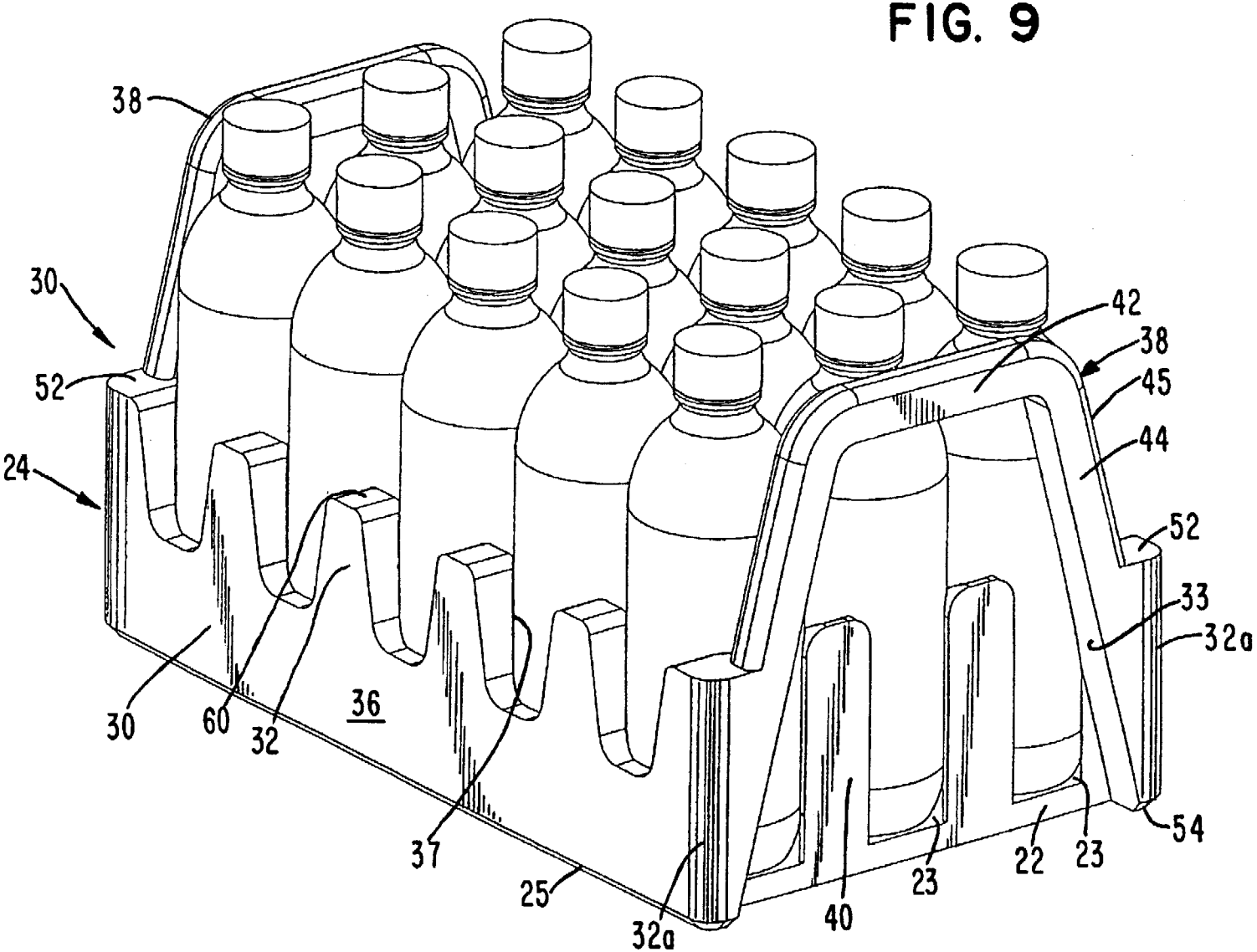
FIG. 9 is a perspective view of the cram of FIG. 1 shown loaded with bottles.

Endwall posts 40 are substantially similar to pylons 32 in height, and are each configured with a substantially vertical exterior surface which is flush with the floor edge and an inwardly projecting portion 46 which protrudes between adjacent bottles as shown in FIG. 9. These projecting portions 46 of posts 40 provide stability to a crate loaded with bottles and prevent undue jostling of the bottles during handling and transport. Each post 40 is preferably configured with a thinner upper portion and a thicker lower portion, and comprises arcuate panels 48 and a lower central panel 50.

Figure 8:
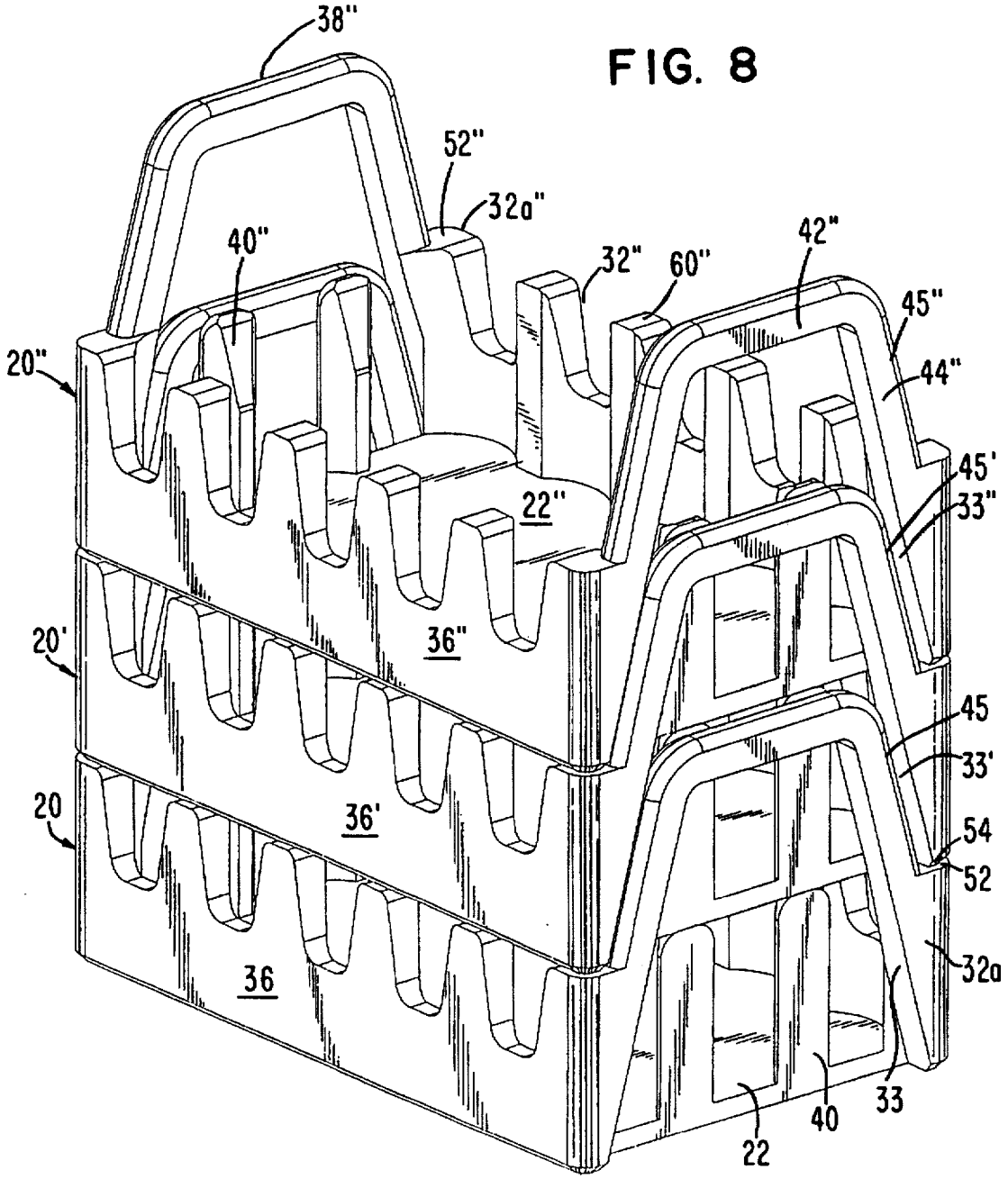
FIG. 8 is perspective view of the crate of FIG. 1 shown nested with identical crates.

Endwalls 28 and specifically handles 38 are adapted to be nested with similar empty crates nested thereabove and therebelow as shown in FIG. 8. Crate 20 is illustrated as the bottom crate, with crate 20' nested thereabove, and crate 20" nested above crate 20'. As is apparent from FIG. 8, handle 38 of crate 20 is nestingly received under handle 38' of crate 20', and exterior nesting surfaces 45 of crate 20 are adapted to engage corresponding interior nesting surfaces 33' of crate 20'. The relationships of the nesting surfaces would be identical in all nested crates. The width of handle 38 is accommodated by the inwardly recessed area of endwall 28 such that in a column of nested crates, the nested endwalls would be flush.

Also important to the nestability of crate 20 with other crates, is the configuration of each corner pylon 32*a* which comprises a substantially horizontal top foot receiving surface 52 disposed outward of the integral handle support 44. The bottom surface of each corner pylon 32*a* includes a foot portion 54. In a nested stack of crates as in FIG. 8, in each corner, foot 54' of crate 20' rests upon foot receiving surface 52 of crate 20 therebelow. In this manner, the weight of above-nested crates is transmitted vertically downward at the corners of the crates and along the sidewalls as described below.

In the first embodiment of the invention, pylons 32 along sidewalls 26 have exterior surfaces which are substantially vertical and flush with exterior lower wall surface 36. In addition, each pylon 32 comprises a substantially vertical center panel 56 which extends the entire height of the pylon, and is arranged to protrude between adjacent bottles when crate 20 is loaded (FIG. 9). Therefore, center panels 56 are inwardly displaced from interior surface 34 of lower wall portion 30. The center panels of adjacent pylons 32, which are generally vertical rectangles, are connected by curved transition portions 58 and interior surface 34 of the lower wall portion. When crate 20 is loaded with bottles, the sides of the bottles are supported by curved transition portions 58 to snugly hold the bottles therein. Each pylon 32 has a substantially horizontal top surface 60 which is equal in height to the top foot receiving portion 52 of corner pylons 32*a*. Referring again to the nested illustration, FIG. 8, the bottom 62' of each sidewall 26' of crate 20' rests upon the tops of pylons 32 in crate 20 therebelow.

Many of the advantages of the present invention relate to the nestability of the crates. As can be seen from the nested illustration, FIG. 8, the particular structural features of crate 20 which lend allow nesting provide for an interlocked, stable nested relationship between crates 20, 20' and 20". These features in crate 20 include, extended handles 38; recessed endwall posts 40 providing nesting surfaces 33 integral with corner pylons 32*a*; the tops of pylons 32 and 32*a*; the foot portions of corner pylons 32*a* and the bottoms 62 of sidewalls 26.

The second preferred embodiment of the invention is illustrated in FIGS. 12–18, and comprises many of the features of crate 20. The second preferred embodiment of the invention will be described using the same reference numerals for corresponding features but prefixed by a digit in the hundreds. Crate 120 also comprises two basic elements: a floor 122 and a wall structure 124. Wall structure 124 defines the periphery of crate 120 with sidewalls 126 and endwalls 128. The wall structure of crate 120 is configured for deeper nesting which conserves even more space than the handle-nesting of crate 20. This is accomplished by providing a wall structure 124 which is angled toward the interior of the crate. This means that lower wall portions 130 are angled toward the interior of the crate and pylons 132 are tapered so that their cross sections at their tops are smaller than their cross sections nearer the lower wall portion. The bottom of wall structure 124 is sufficiently open so that pylons 132 in a crate therebeneath can nest therein. In particular, lower wall portion 130 also has an open bottom so that empty crates can be nested together. Corner pylons 132*a* are also tapered to nest within corresponding corner pylons in a crate nested thereabove. An additional feature of the second embodiment of the present invention is the provision of a flat label section 131 formed as part of exterior lower wall surface 136 for molding in logos, advertisements or the like.

Each endwall 128 of crate 120 is comprised of a handle 138 which is extended above the tops of pylons 132 and 132*a* sufficiently to allow either palm-up or palm-down handling. Each handle 138 comprises a substantially horizontal handle bar 142 and angled handle supports 144 each extending upward from a corner pylon 132*a*. The length of the handle supports may vary, but preferably is determined so that the handle bars are located well above the center of gravity of the crate for easy lifting.

As with crate 20, the bottom portions of handle supports 144 include an interior nesting surface 133, and the top portions of the handle supports include an exterior nesting surface 145. When crates 120 and 120' are nested (FIG. 17), nesting surfaces 145 nest under a handle 138' and are in contact with nesting surfaces 133'. The space under each of the handles is preferably void of other structure to provide maximum visibility of the bottles therethrough.

When empty crates 120 and 120' are nested, pylons 132' and 132*a*' of upper crate 120' nest onto or above corresponding pylons 132 and 132*a* of lower crate 120 such that pylons 132 and 132*a*, in effect, travel upward inside of pylons 132' and 132*a*'respectively. Pylons 132 are arranged between adjacent bottle support areas 123 of the floor and define spaces or windows 137 therebetween through which the bottles are visible.

Each corner pylon 132*a* preferably has an aperture 170 on the interior surface thereof to allow sufficient clearance for a below-nested corner pylon to nest or travel into. The upper interior portions of corner pylons 132*a* include corner panels 172 which extend down from the tops of the corner pylons to apertures 170. Corner panels 172 are curved to support the side of a bottle in the adjacent receiving area.

Similarly, side pylons 132 are also configured to allow sufficient clearance for below-nested side pylons to nest into. The interior sides of side pylons 132 also have apertures 174, but instead of being left open, an integral central panel 176 having an upper panel portion and a lower panel portion extends down to and is integral with floor 122. Central panels 176 are preferably angled outwardly from the floor toward the top of the pylons so as to extend somewhat between adjacent bottles when crate 120 is loaded to snugly support the bottles.

The extent of travel inside of the pylons by pylons in a crate nested below may be controlled by the interference between them. Alternatively, crate 120 may be provided with positive "stops" to prevent nested crates from becoming wedged together. One type of stop may be disposed inside some or all of the hollow pylons, and another type of stop may be disposed on the outside of the pylons. The inside the pylon stops may be integrally formed in the hollow spaces inside pylons 132 and 132*a*, and located in the upper parts of the pylons such that they are hidden from view by corner panels 172 and the upper parts of central panels 176. When crates are nested, these stops would rest on the tops of pylons 132 and 132*a* of the crate therebelow. In addition, the outside the pylon stops may be integrally formed structures on the central panels 176 of side pylons 132, or elsewhere on the wall structure.

For both embodiments of the crate, the floor is illustrated as a plain, solid floor with bottle receiving areas 23 and 123. It is contemplated, however, that the floor of either embodiment of the crate may have a lattice-like configuration having a pattern of open spaces. An open floor design provides a light weight crate, and is practical for allowing any liquids to drain through the floor. The floor should be generally flat and open so as not to interfere with secondary wraps or binding means around multi-packs of bottles such as plastic wrap. The upper surface of the floor includes a plurality of preferably circular support areas for supporting bottles thereon. The lattice configuration of the floor may be comprised of a system of grid-like longitudinal struts and lateral struts traversing the floor in perpendicular relation to one another, and diagonal struts extending radially from the support areas.

The floor may also have a bottom surface which is adapted to allow for stacking and cross-stacking of loaded crates. Cross-stacking is done by rotating a top crate 90 degrees about a vertical axis and lowering onto a bottom crate or crates. During shipping and handling crates may be moved by machines and it is advantageous to use crates which can be stably stacked or cross-stacked. Additionally, when the crates are used to display the bottles in a retail setting, the retailer may wish to cross-stack the crates for display or space reasons.

The floor bottom surface may have a plurality of upwardly recessed bottle top receiving areas which are integrally molded with and form part of the floor bottom surface. The positions of the receiving areas are chosen to provide a range within which the bottle tops in a loaded crate therebeneath may reside and still provide safe stacking and cross-stacking. The receiving areas would help retain bottles in vertically upright positions to bear the load of crates stacked or cross-stacked thereabove. The peripheral surfaces of the receiving areas may be beveled so that while a crate is prevented from sliding when in the stacked or cross-stacked positions, once the receiving areas are disengaged from their retaining positions, the upper crate may slide along the bottle tops in the lower crate to facilitate handling. The bevel would allow the crate to ride up onto the bottle tops in a lower crate when the upper crate is rotated slightly about a vertical axis.

The crate of the present invention combines the features of nestability, strength and visibility. In constructing the crate, many design parameters must be determined with the goal of enhancing the above mentioned characteristics without unduly sacrificing any of them. Visibility is important both for permitting attractive display but also for ensuring that UPC labels on the sides of the bottles may be read or scanned through the windows without having to remove them from the crate. Increasing visibility of the bottles, that is, enlarging the windows between the pylons means decreasing the size of the pylons which results in an overall reduction in strength. In addition, large windows increases the chance of bottles hopping out of the crate through the windows. The present invention balances these parameters to provide maximum visibility for its size without sacrificing strength and nestability.

The exact number of support areas can be varied to yield crates having different capacities from the preferred embodiments. In the first preferred embodiment one of the invention, a three by five array accommodates fifteen bottles. In the second preferred embodiment, bottles are arranged in a two by four array of twelve. Of course the crate can be sized up or down for holding smaller or larger bottles as desired. In addition, although rectangular crates are shown and described, the present invention is not limited thereto and may comprise sidewalls and endwalls of equal length resulting in a square crate.

From the foregoing detailed description, it will be evident that there are a number of changes, adaptations, and modifications of the present invention which come within the province of those skilled in the art. However, it is intended that all such variations not departing from the spirit of the invention be considered as within the scope thereof as limited solely only by the claims appended hereto.

What is claimed is:

1. In a low depth crate for bottles, the crate having a floor and a wall structure integral with the floor, the floor having a floor top surface and floor bottom surface, the floor top surface having thereon a plurality of support areas for supporting an array of bottles, the wall structure integral with the floor and extending around the periphery thereof and including opposing sidewalls and opposing endwalls, the improvements comprising:

a pair of extended handles extending above the wall structure, each handle having a handle bar integral with the wall structure, said handle bars formed on an opposing ones of the sidewalls, said handles being adapted to nestingly receive handles of a similar crate nested therebelow when said crate and similar crate are empty and nested together.

2. The low depth crate of claim 1, wherein each said handle is integral with an opposing one of the endwalls, and each said handle's upward extent is less than the height of the bottles loaded in said crate so as to not interfere with stacking and handling of crates loaded with bottles.

3. The low depth crate of claim 1, wherein the sidewalls of the wall structure each comprise:

a lower wall portion adjacent and integral with the floor, said lower wall portion being of double-walled construction and including an interior lower wall portion and an exterior lower wall portion; and a plurality of sidewall pylons extending up from the floor and beyond the top of said lower wall portion, said sidewall pylons spaced along the sidewall and defining spaces therebetween through which bottles loaded in the crate are visible, wherein the interior surfaces of said sidewall pylons are integral with said interior lower wall portion and the exterior surfaces of said sidewall pylons are integral with said exterior lower wall portion.

4. The low depth crate of claim 3, further comprising corner pylons disposed at the corners of the crate, said corner pylons being integral with said handles, and adapted to nestingly receive handles of a similar crate nested therebelow.

5. The low depth crate of claim 4, wherein said sidewall pylons and said corner pylons are tapered and angled toward the inside of the crate, and hollow through at least a lower portion thereof so as to allow corresponding pylons of a similar crate nested below to nest thereinto.

6. The low depth crate of claim 5, wherein each of said sidewall pylons includes a nesting aperture to provide sufficient clearance for said sidewall pylons to nestingly receive corresponding sidewall pylons of a similar crate nested therebelow.

7. The low depth crate of claim 6, wherein each of said sidewall pylons includes a central panel bisecting said nesting aperture and extending down from the top of said sidewall pylon to be integral with the floor, said central panel adapted to protrude between adjacent bottles of a loaded crate in order to support the bottles in a vertical orientation.

8. The low depth crate of claim 6, wherein said corner pylons each includes a nesting aperture to provide sufficient clearance for said corner pylons to nestingly receive corresponding corner pylons of a similar crate nested therebelow.

9. In a low depth crate for bottles, the crate having a floor and a wall structure integral with the floor, the floor having a floor top surface and floor bottom surface, the floor top surface having thereon a plurality of support areas for supporting an array of bottles, the wall structure integral with the floor and extending around the periphery thereof and including opposing sidewalls and opposing endwalls, the improvements comprising:

a pair of extended handles, each handle being integral with the wall structure and extending above the wall structure, said handles being adapted to nestingly receive handles of a similar crate nested therebelow when said crate and similar crate are empty and nested together;

corner pylons disposed at the corners of the crate, said corner pylons being integral with said handles, and adapted to nestingly receive handles of a similar crate nested therebelow; and wherein the sidewalls of the wall structure each comprise a lower wall portion adjacent and integral with the floor, said lower wall portion being of double-walled construction and including an interior lower wall portion and an exterior lower wall portion, and a plurality of sidewall pylons extending up from the floor and beyond the top of said lower wall portion, said sidewall pylons spaced along the sidewall and defining spaces therebetween through which bottles loaded in the crate are visible, wherein the interior surfaces of said sidewall pylons are integral with said interior lower wall portion and the exterior surfaces of said sidewall pylons are integral with said exterior lower wall portion.

10. The low depth crate of claim 9, wherein said sidewall pylons and said corner pylons are tapered and angled toward the inside of the crate, and hollow through at least a lower portion thereof so as to allow corresponding pylons of a similar crate nested below to nest thereinto.

11. The low depth crate of claim 10, wherein each of said sidewall pylons includes a nesting aperture to provide sufficient clearance for said sidewall pylons to nestingly receive corresponding sidewall pylons of a similar crate nested therebelow.

12. The low depth crate of claim 11, wherein each of said sidewall pylons includes a central panel bisecting said nesting aperture and extending down from the top of said sidewall pylon to be integral with the floor, said central panel adapted to protrude between adjacent bottles of a loaded crate in order to support the bottles in a vertical orientation.

13. The low depth crate of claim 11, wherein said corner pylons each includes a nesting aperture to provide sufficient clearance for said corner pylons to nestingly receive corresponding corner pylons of a similar crate nested therebelow.

* * * * *